US006494115B1

(12) United States Patent
Haugen et al.

(10) Patent No.: US 6,494,115 B1
(45) Date of Patent: Dec. 17, 2002

(54) LEFT FOOT ACCELERATOR PEDAL

(75) Inventors: Wayne Alfred Haugen, Brooten, MN (US); Lynn Ringdahl, Alexandria, MN (US)

(73) Assignee: The Braun Corporation, Winamac, IN (US)

( * ) Notice: Subject to any disclaimer, the term of this patent is extended or adjusted under 35 U.S.C. 154(b) by 0 days.

(21) Appl. No.: 09/527,793

(22) Filed: Mar. 17, 2000

(51) Int. Cl.[7] ..... G05G 1/16

(52) U.S. Cl. ..... 74/562; 74/562.5; 74/512; 74/513; 74/560; 180/320; 180/90.6

(58) Field of Search ..... 74/562.5, 562, 74/512, 513, 560; 180/320, 90.6

(56) References Cited

U.S. PATENT DOCUMENTS

| | | | | | |
|---|---|---|---|---|---|
| 2,175,772 | A | * | 10/1939 | Gintling | 74/513 |
| 2,235,852 | A | * | 3/1941 | Rubissow | 74/513 |
| 2,253,850 | A | | 8/1941 | Fisher | |
| 2,799,181 | A | | 7/1957 | Speckman | |
| 2,829,539 | A | | 4/1958 | Wilcox | |
| 2,914,961 | A | | 12/1959 | Ewer | |
| 3,199,369 | A | | 8/1965 | Kaul | |
| 3,224,293 | A | | 12/1965 | DeRose | |
| 3,224,294 | A | | 12/1965 | Gresham | |
| 3,477,310 | A | | 11/1969 | Garcia | |
| 3,543,606 | A | | 12/1970 | Kaul | |
| 3,626,785 | A | | 12/1971 | Ross | |
| 4,310,193 | A | * | 1/1982 | Kolleas | 296/75 |
| 4,312,246 | A | | 1/1982 | Barresi | |
| 4,480,496 | A | * | 11/1984 | Marshall | 74/532 X |
| 4,587,865 | A | * | 5/1986 | Winner | 74/562.5 |
| 5,168,771 | A | | 12/1992 | Fujimori | |
| 5,451,939 | A | | 9/1995 | Price | |
| 5,487,317 | A | | 1/1996 | Richhart | |
| 5,839,326 | A | * | 11/1998 | Song | 74/562 |

* cited by examiner

*Primary Examiner*—Vinh T. Luong
(74) *Attorney, Agent, or Firm*—Michael Best & Friedrich

(57) ABSTRACT

A left foot accelerator pedal device which allows persons lacking sufficient functionality of the right foot or right leg to operate a motor vehicle accelerator pedal using their left foot. The device incorporates an accelerator pedal activator which engages the motor vehicle accelerator pedal and is operably attached by a main shaft to a left side accelerator pedal. The main shaft is supported by a base unit which is removably attached to a base plate affixed to the vehicle floor. By depressing left side accelerator pedal a person lacking functionality of the right foot may operate the vehicle while the device may be easily removed from base plate allowing a person of normal functionality to operate the vehicle.

10 Claims, 5 Drawing Sheets

LEFT FOOT ACCELERATOR PEDAL

TECHNICAL FIELD

The invention relates generally to vehicles having accelerator pedals typically engaged by an operator's right foot. More specifically, the invention relates to a device that permits engagement of an accelerator pedal via an operator lacking functional use of their right foot. More specifically, the device is configured to permit easy removal from the vehicle such that the accelerator pedal is easily engaged by an operator's right foot.

BACKGROUND

The automotive industry has long designed and employed devices permitting remote accelerator pedal engagement. These devices include combination accelerator pedal and brake pedal arrangements that permit remote engagement of both pedals from the side of a vehicle opposite that of the driver. Combination pedals such as these have long been installed and used in vehicles used to teach student drivers how to operate a motor vehicle. The student actually operates the vehicle from the standard position, yet the instructor has the ability to assume control of the vehicle in an emergency situation. In some cases, these vehicles can also be equipped with a supplemental steering wheel placed in front of the instructor. Examples of patents generally directed to these types of devices include Speckman, U.S. Pat. No. 2,799,181; Garcia, U.S. Pat. No. 3,477,310; and Barresi, U.S. Pat. No. 4,312,246.

Another type of remote pedal operation includes extensions used to change the effective vertical position of the pedal. These extensions permit operation of the pedal by a person having, for example, shorter than average legs. With the increasing popularity of vehicles equipped with passive restraint systems such as air bags, there is a growing concern over drivers who sit too close to the steering wheel. Vertical pedal extensions can permit such drivers to sit a safe distance from the steering wheel yet still comfortably and effectively engage the accelerator and brake pedals. Examples of patents describing pedal extensions include Ross, U.S. Pat. No. 3,626,785; and Upton, U.S. Pat. No. 5,451,939.

Yet another type of remote pedal operation involves operation of an accelerator pedal by the left foot. Typically, modem automobiles and other similar vehicles are designed such that the accelerator and brake pedal are both engaged by the operator's right foot. If the vehicle is equipped with a manual transmission, the clutch is typically engaged by the operator's left foot. While a certain minority of drivers operating vehicles equipped with automatic transmissions use their left foot for the brake and their right foot for the gas, the vehicles are designed for normal right foot engagement of both pedals.

Various devices have been devised to permit left foot operation of a vehicle's accelerator pedal. Patents describing such devices include, for example, Fisher, U.S. Pat. No. 2,253,850; Wilcox, U.S. Pat. No. 2,829,539; Ewer, U.S. Pat. No. 2,914,961; Kaul, U.S. Pat. Nos. 3,199,369 and 3,543,606; DeRose, U.S. Pat. No. 3,224,293; Gresham, U.S. Pat. No. 3,224,294; and Richhart, U.S. Pat. No. 5,487,317.

In addition to the devices described in the patents discussed herein, several commercially available devices also exist. These devices typically include a mounting plate or base that attaches to the vehicle floor, as well as a main body or cover that fits over the mounting plate. This main body or cover typically supports an elongated shaft that serves to operatively connect a left foot gas pedal with the vehicle accelerator pedal. These devices also include mechanisms that permit removal of the main body when not needed.

FIG. 4 partially illustrates one such device 400 having a main body 402 and a mounting plate 410. The main body 402 is seen as supporting a main shaft 420 that would continue to the left, operatively supporting a left foot gas pedal while the main shaft 420 would, at the right periphery, support an accelerator pedal actuator of some form.

The main body 402 is releasably attached to the mounting plate 410. Spring guide shaft 450 extends parallel with the main shaft 420 and is biased towards the left (as drawn) via a biasing spring 455 that partially surrounds the spring guide shaft 450. Two mounting tabs 430 and 432 are secured to the spring guide shaft 450 and interact with two mounting flanges 440 and 442, respectively, that are formed within the mounting plate 410. In the position shown in the Figure, this interaction substantially prevents movement of the device 400 in either a vertical or horizontal fashion.

The spring guide shaft 450 is movable from a secured position (as shown) in which the mounting tabs 430 and 432 cooperate with mounting flanges 440 and 442, respectively, to prevent movement of the main body 402 in relation to the mounting plate 410 to a release position (not shown) in which the mounting tabs 430 and 432 have moved sufficiently to the left (with the spring guide shaft 450) to clear the mounting flanges 440 and 442.

The mounting plate 410 includes a number of mounting apertures 415 suitable for bolting the mounting plate 410 to the floor of an automobile or other similar vehicle. Since typical vehicles have carpeted floors, it is possible that debris such as carpet fibers could interfere with operation of device 400; in particular, interfere with the interaction between mounting tabs 430 and 432 and mounting flanges 440 and 442, respectively. The location of the spring guide shaft 450 is such that it could conceivably be accidentally moved into a release position by an operator's foot, possibly with dire consequences.

Another commercial device is seen in FIG. 5, which partially shows a device 500 having a main body 502 and a mounting plate 510. This device 500 is believed to be an embodiment of Fujimori, U.S. Pat. No. 5,168,771. A main shaft 525 is supported by the main body 502 and extends from an accelerator guard plate 550 on the left (as shown) to a left foot gas pedal (not shown) on the right hand side. The mounting plate 510 is presumably secured to the floor of an automobile or similar vehicle by bolting through a mounting slot 515.

The main body 502 is releasably attached to the mounting plate 510. Seen at the left end of the mounting plate 510 is a latch mechanism 530 that includes a latch pin aperture 532 that can receive a latch pin 520 seen on the bottom surface of the main body 502. The latch mechanism 530 also includes several latch tabs 534 that cooperate with latch tab slots 544 present in the main body 502. The latch pin 520 is biased in its illustrated position by an unseen biasing spring that runs parallel to the main shaft 525. The unseen biasing spring is compressed by moving the accelerator guard plate 550 to the right as illustrated. The latch pin 520, which engages latch pin aperture 532, moves the latch mechanism 530 such that latch tabs 534 are retracted.

Once the mounting plate 510 is secured to a vehicle floor, the main body 502 can be releasably attached. The device 500 is tipped such that latching brace 560 of the first end of the device 500 engages the end 565 of the mounting plate 510. Then, the other end of the device 500 is lowered downward. While this can be done with the latch pin 520 biased in a release position, it is preferable that the second end of device 500 simply be pushed down into a latched position. Since the latch tabs 534 are angled, they will partially retract themselves sufficiently to permit installation of the main body 502. Once the main body 502 is fully seated, the latch tabs 534 will snap back into their latched position and will secure the main body 502 to the mounting plate 510.

To release the main body 502 when not needed, the accelerator guard plate 550 is moved laterally towards the (unseen) left foot gas pedal, thereby moving the latch pin 520 in the same direction. The latch pin 520 engages the latching mechanism 530 and forces the latching mechanism 530 into retracting the latch tabs 534. This end of the main body 502 can then be pulled upward away from the mounting plate 510. The other end of the main body 502 is then easily released as well.

While mounting plate 510 appears to mount directly on the floor of an automobile or similar vehicle, it serves to elevate the latch mechanism 530 and the corresponding latch pin 520 to avoid possible entanglements with carpet fibers and other debris. However, this results in a mounting plate that extends vertically from the vehicle floor and therefore presents an elevated profile. Further, it appears possible to release the main body 502 from the mounting plate 510 using only one's foot to kick the accelerator guard plate 550 in a direction towards the left foot gas pedal.

Accordingly, a need remains for a left foot gas pedal device that is easy to install and remove, yet is securely positioned without possibility of accidental disengagement.

SUMMARY OF THE INVENTION

The invention involves a device that permits an individual who is lacking sufficient functionality in their right foot or right leg to operate a vehicle accelerator pedal using their left foot. This device, when installed, prevents inadvertent engagement of the original vehicle accelerator pedal without engaging the left side pedal. The left foot gas pedal described herein can be installed easily and securely into an automobile or related vehicle yet is easily removable for vehicle use by a driver having the full use of their right leg and/or foot.

We have discovered that such a device can be constructed by altering how the main body is secured to the mounting plate. We have discovered that a device in which the release mechanism functions in a direction that is perpendicular to the main shaft is significantly less susceptible to inadvertent disengagement. We have discovered that a release mechanism requiring a pulling action is less susceptible to accidental release than one requiring a pushing action.

Accordingly, the invention is found in a left foot gas pedal assembly that includes a mounting assembly and a main body that is releasably secured to the mounting assembly. The pedal assembly described herein also has a left foot gas pedal that is operatively connected through a main shaft to an existing vehicle accelerator pedal, wherein the main shaft is rotatably supported by the main body. The assembly also has a locking mechanism that includes a locking tab moveable from an unlocked position to a locked position in a direction perpendicular to the main shaft, wherein the locking tab engages a slot in the mounting assembly when in the locked position.

These and other features as well as advantages that characterize the present invention will be apparent from a reading of the following detailed description and a review of the associated drawings.

DETAILED DESCRIPTION OF PREFERRED EMBODIMENTS

Figure 1:
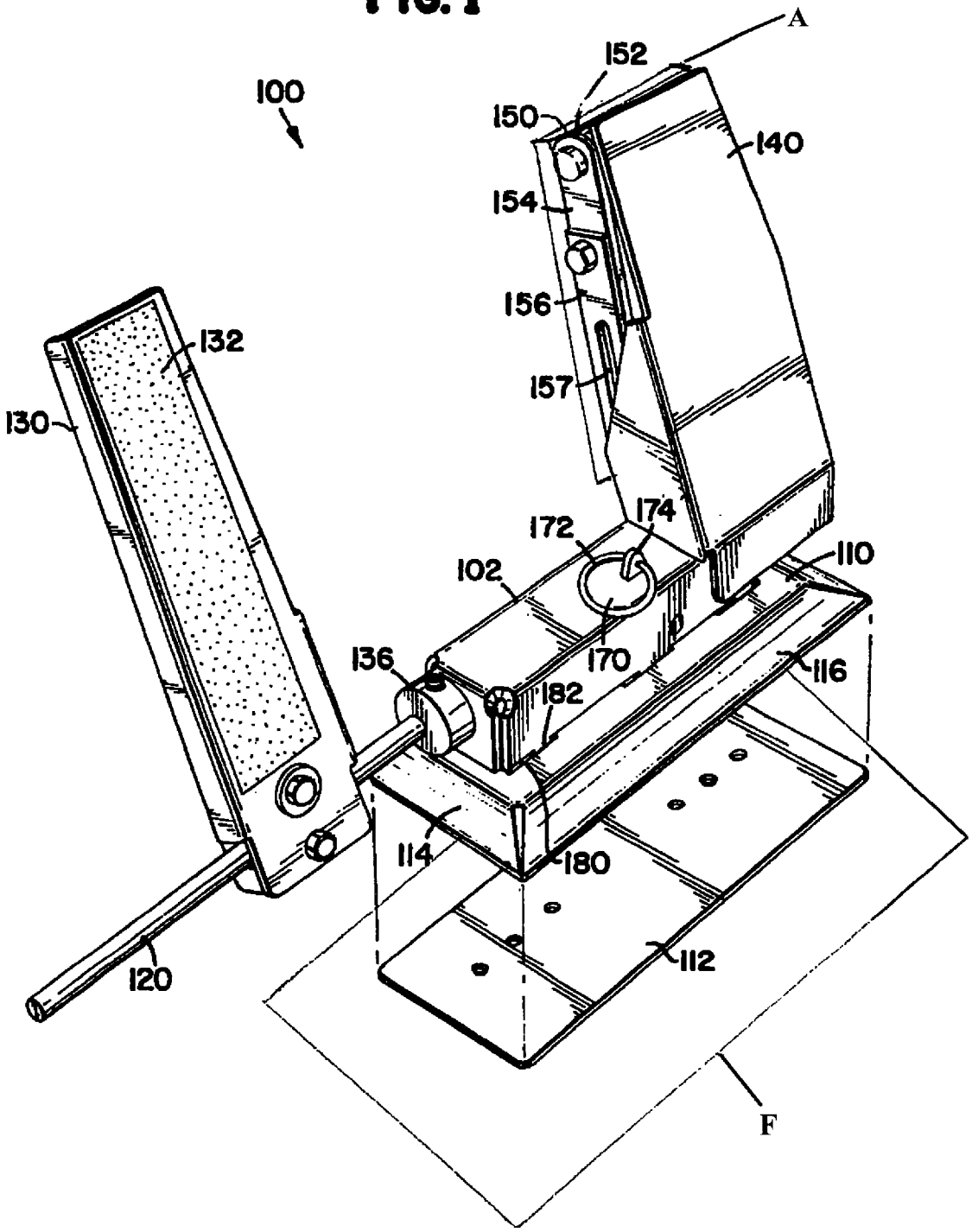
FIG. 1 is a front perspective view of a left foot gas pedal assembly in accordance with a preferred embodiment of the present invention.

Preferred embodiments of the present invention are best understood through the Figures, in which similar reference numbers are used to refer to similar elements in multiple views. FIG. 1 is a perspective view of a left foot gas pedal assembly 100 made in accordance with a preferred embodiment of the present invention. The gas pedal assembly 100 has a main body 102 and a base 110. Preferably, the gas pedal assembly 100 also has a base plate 112 that serves to create a volume underneath the base 110 that is free of carpet fibers and other debris that could otherwise interfere with the safe operation and installation of the gas pedal assembly 100. Together, the base 110 and base plate 112 are considered to form a mounting assembly.

Figure 2:
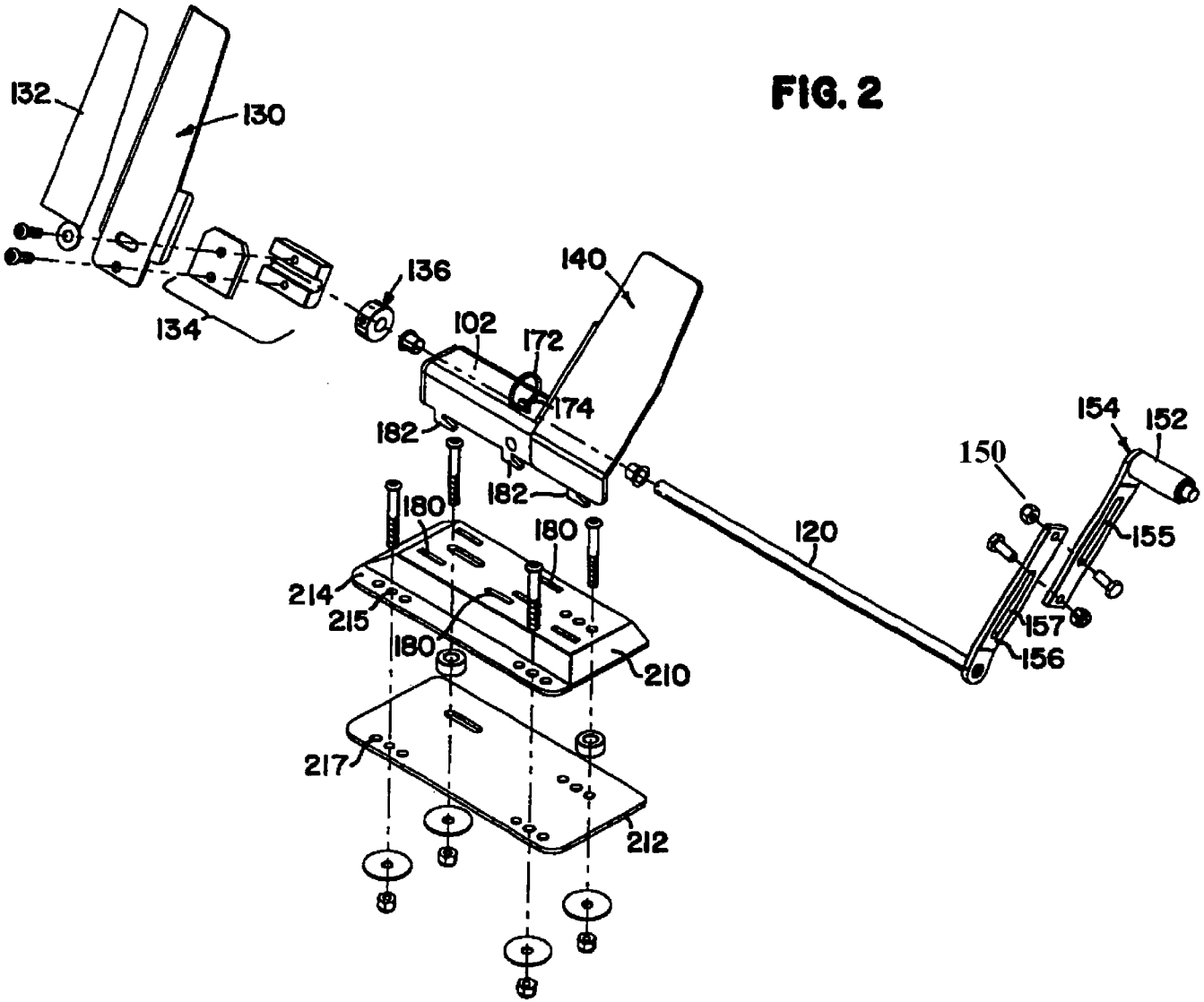
FIG. 2 is an exploded perspective view of a left foot gas pedal assembly in accordance with another preferred embodiment of the present invention.

FIG. 2 illustrates a slightly different embodiment of the invention. In this Figure, base plate 210 has a mounting tab 214 that provides additional mounting holes 215. One of skill in the art will readily recognize that base 210 (or 110) can utilize a variety of different bolt patterns for mounting the base 110, 210 to a vehicle floor F. The base plate 112, 212 will of course have a bolt pattern that is complementary to that present in the base 110, 210. Such modifications do not affect the spirit or intent of the present invention.

The main body 102 rotatably supports a main shaft 120 that operatively connects a left foot gas pedal 130 and an accelerator pedal activator 150. The left foot gas pedal 130 preferably includes a non-slip surface 132 that could be painted onto the surface of the pedal 130. Alternatively, the non-slip surface 132 can also be applied in the form of an adhesive sticker. The left foot gas pedal 130 can be mounted to the main shaft 120 in an infinite number of different positions to accommodate differences in various automobiles and other vehicles, as well as differences in individual vehicle operators. The gas pedal 130 is mounted to the main shaft 120 via a mounting bracket, which is generally seen in FIG. 2. Preferably, once the gas pedal 130 is properly located on the main shaft 120, the excess length (if any) of the main shaft 120 is cut off.

On the other end of the left foot gas pedal assembly 100, the accelerator pedal activator 150 is protected by an accelerator guard 140. Preferably, the accelerator guard 140 is welded in place to the main body 102. Alternatively, the accelerator guard 140 could also be bolted or riveted to the main body 102.

The accelerator pedal activator 150 is seen in FIG. 2 as including an upper activator arm 154 and a lower activator arm 156. Preferably, the upper activator arm 154 includes an elongate slot 155 while the lower activation arm 156 includes an elongate slot 157. Preferably, elongate slot 155 cooperates with elongate slot 157 to provide for an adjustable length for the accelerator pedal activator 150. The accelerator pedal activator 150 includes a roller 152 that provides contact between the accelerator pedal activator 150 and a vehicle accelerator pedal A as shown in FIG. 1. A roller 152 is preferred as it permits the accelerator pedal activator 150 to smoothly traverse the accelerator pedal A as the left foot gas pedal 130 is depressed.

The main body 102 is removably secured to the base 110, 210 through the cooperation between mounting tabs 182, fashioned as part of the main body 102, and mounting slots 180 that are formed within the base 110, 210. The mounting tabs 182 are configured such that they fit vertically down into mounting slots 180. Once inserted, the main body 102 can be moved toward the right (as illustrated in FIG. 2), thereby preventing vertical movement of the main body 102 in relation to the base 110, 210. Horizontal movement, however, is prevented via a locking mechanism 170.

Figure 3B:
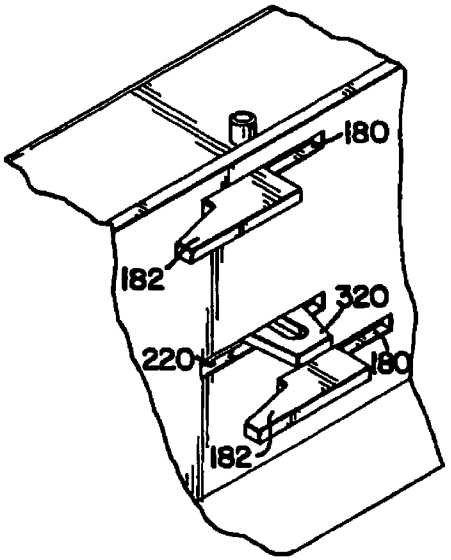
FIG. 3B is a bottom perspective view as in FIG. 3A, showing the main body locked into position on the mounting plate.
Figure 3A:
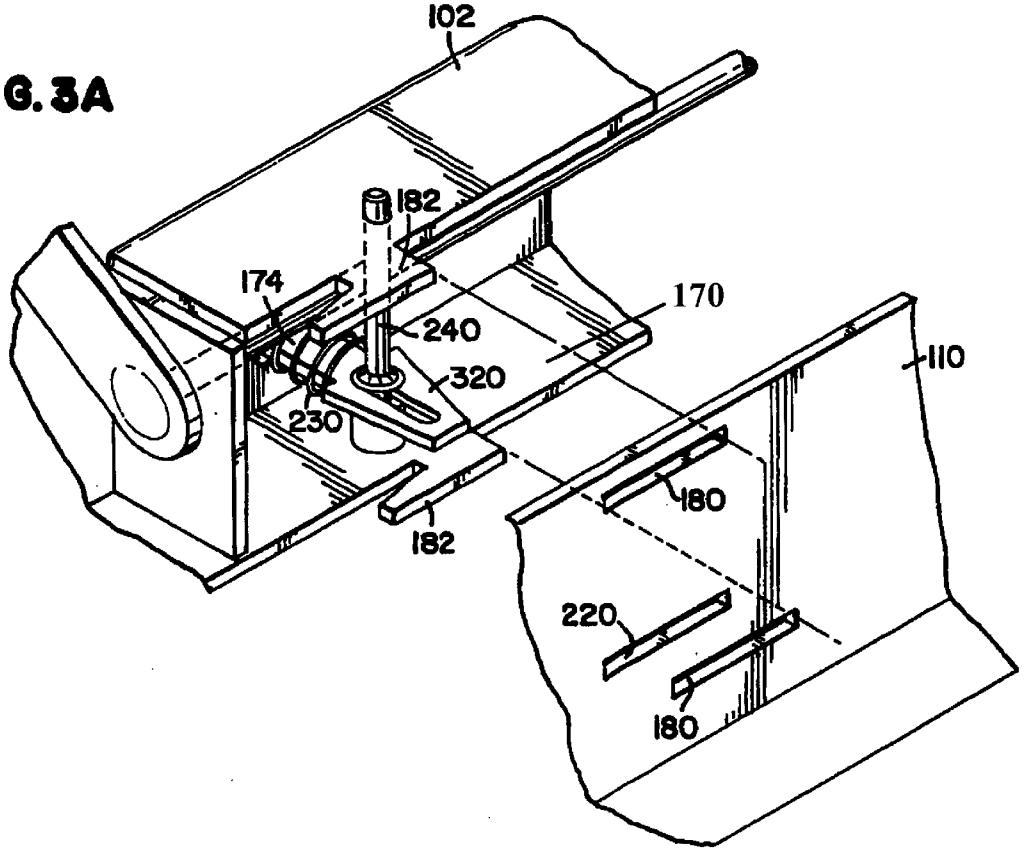
FIG. 3A is a bottom perspective view of a portion of the left foot gas pedal assembly as seen in FIG. 1, illustrating the locking mechanism of the assembly.
Figure 4:
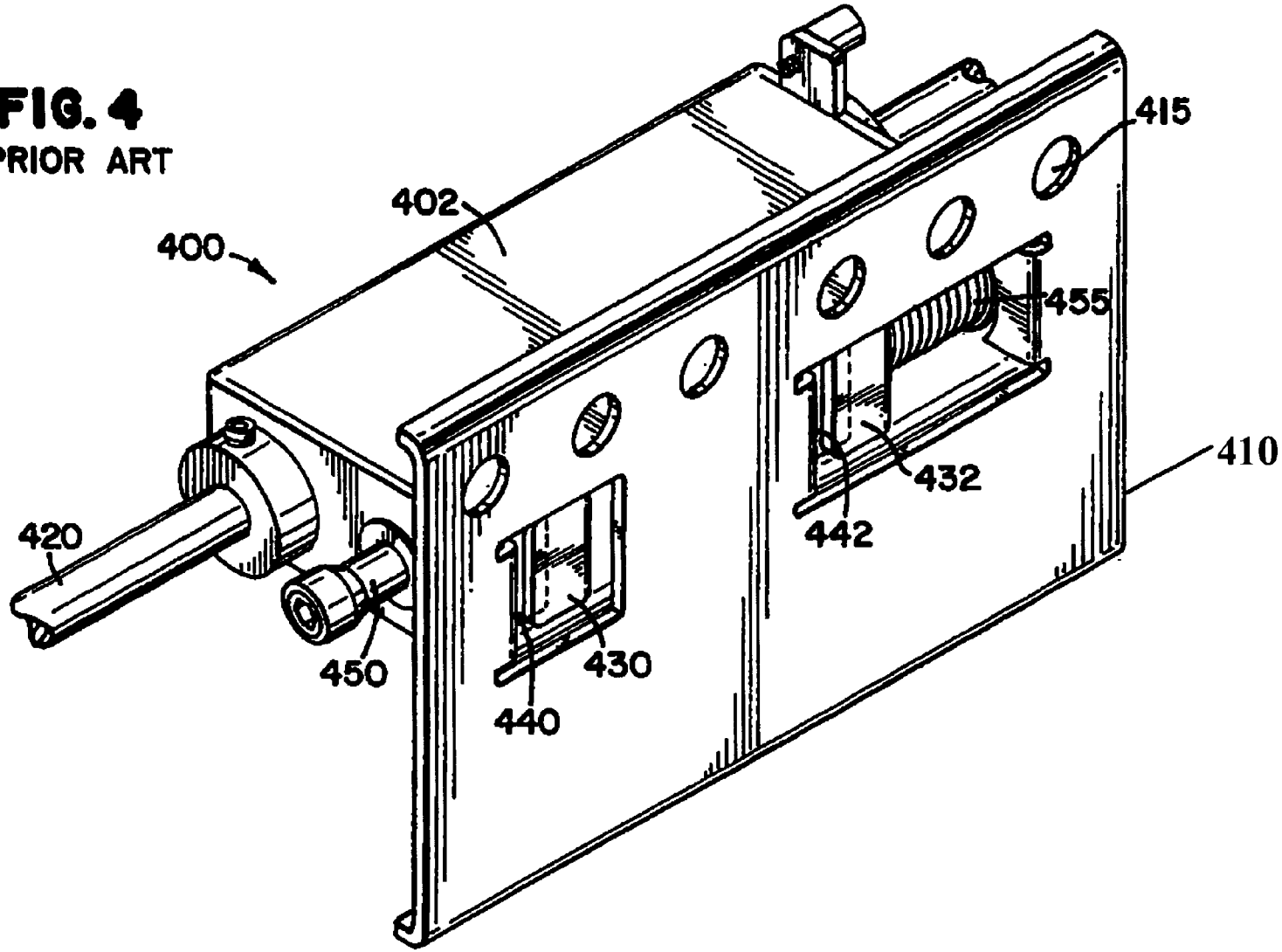
FIG. 4 PRIOR ART
FIG. 4 is a bottom perspective view of a prior art device.
Figure 5:
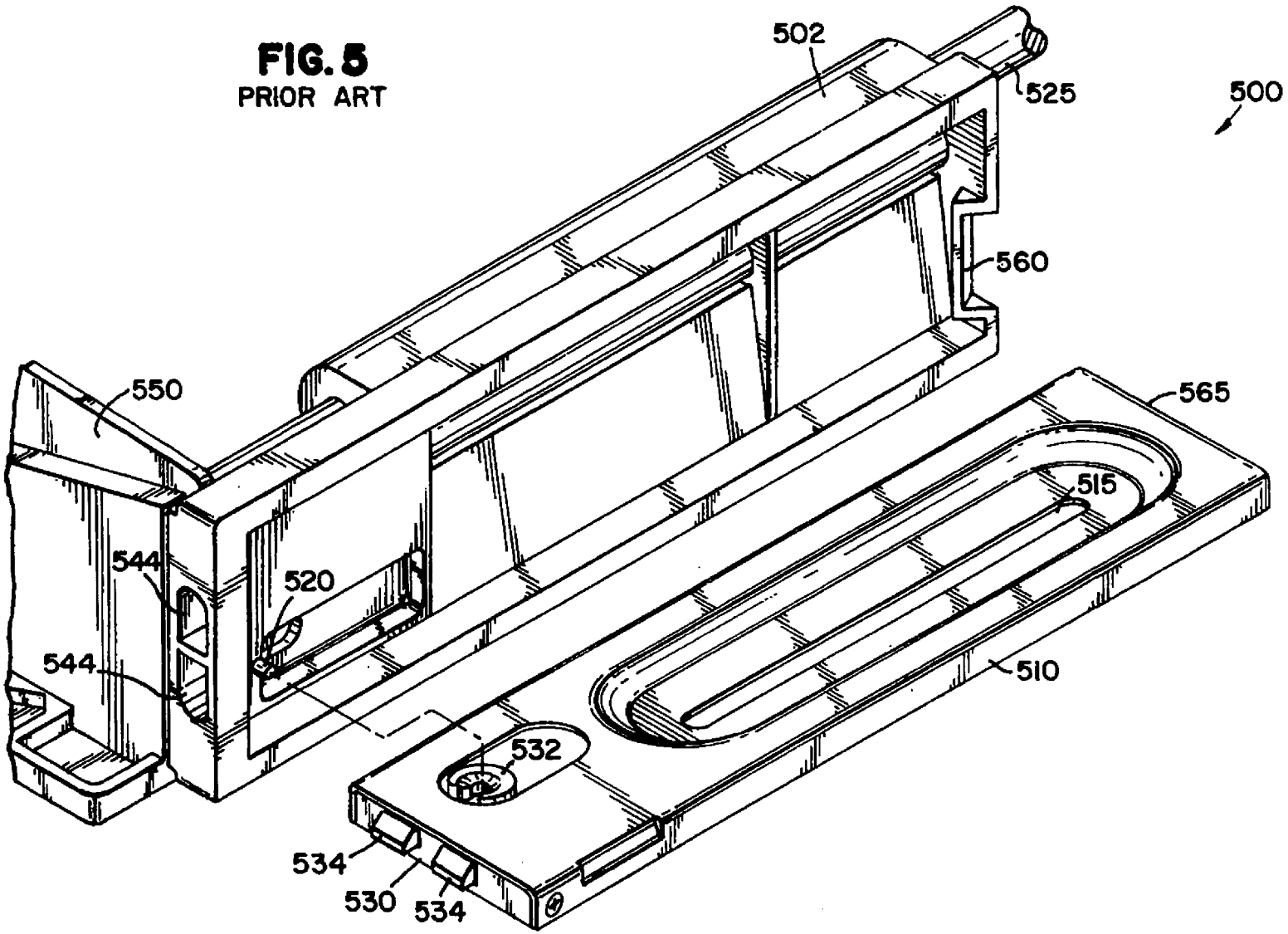
FIG. 5 PRIOR ART
FIG. 5 is a bottom perspective view of a prior art device.

The locking mechanism 170 includes a latch 174 that is preferably connected to a pull ring 172 for ease of operation. FIGS. 3A and 3B illustrate how the locking mechanism 170 functions. Preferably, latch 174 includes a biasing spring 230 that biases the latch into an extended, latched position. As previously described, mounting tabs 182 fit into mounting slots 180 and the main body 102 is then slid laterally to prevent vertical movement. Once the main body 102 has been moved laterally, a lower end 320 of the latch 174 is able to extend downward into a latch slot 220 that is formed within the base 110, 210. Once engaged, the latch 174 prevents lateral movement of the main body 102 in relation to the base 110, 210. The engaged position is illustrated in FIG. 3B.

A key feature of the left foot gas pedal assembly 100 is that once installed, it is easily removable yet is designed to prevent accidental disengagement. To separate the main body 102 from the base 110, it is necessary to pull upward on the pull ring 172. This compresses the biasing spring 230 and permits the latch 174 to withdraw from the latch slot 220. The main body 102 can then be moved laterally and lifted off from the base 110. The motion necessary to disengage the locking mechanism 170 is perpendicular to that necessary to release the main body 102 from the base 110, 210.

It will be clear that the present invention is well adapted to attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

We claim:

1. A left foot gas pedal assembly comprising:

a mounting assembly which comprises a base comprising a plurality of mounting slots and further comprises a base plate in underlying relation to the base; the base plate providing a volume underneath the base free of interfering substances;

a main body releasably secured to the mounting assembly;

a left foot gas pedal operatively connected through a main shaft to an existing vehicle accelerator pedal, wherein the main shaft is rotatably supported; and a locking mechanism comprising a locking tab moveable from an unlocked position to a locked position in a direction perpendicular to the main shaft, wherein the locking tab engages a slot in the mounting assembly when in the locked position.

2. The assembly of claim 1 wherein the main shaft is rotatably supported by the main body.

3. The assembly of claim 1 wherein the mounting assembly is secured to a vehicle floor.

4. The assembly of claim 1 further comprising an actuator arm that operatively connects the main shaft to the vehicle accelerator pedal.

5. The assembly of claim 4 wherein the actuator arm comprises an upper actuator arm and a lower actuator arm, each of the lower actuator arm and the upper actuator arms comprising an elongate slot that permits adjustments in a length of the actuator arm.

6. The assembly of claim 5 wherein the upper actuator arm further comprises a roller assembly that contacts the vehicle accelerator pedal in response to movement of the left foot gas pedal.

7. The assembly of claim 5 wherein the locking mechanism further comprises a biasing spring.

8. The assembly of claim 1 wherein the locking tab is biased in the locked position.

9. The assembly of claim 1 wherein the locking mechanism, in the locked position, prevents lateral movement of the main body relative to the mounting assembly.

10. The assembly of claim 1 wherein the locking mechanism requires an upward pulling motion for disengagement.

* * * * *